US012234754B2

(12) United States Patent
Schmidt et al.

(10) Patent No.: US 12,234,754 B2
(45) Date of Patent: Feb. 25, 2025

(54) CAMSHAFT ADJUSTER WITH RESET FUNCTION

(71) Applicant: Schaeffler Technologies AG & Co. KG, Herzogenaurach (DE)

(72) Inventors: Volker Schmidt, Burgbernheim (DE); Juergen Weber, Erlangen (DE); Thomas Werblinski, Furth (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 18/689,908

(22) PCT Filed: Aug. 10, 2022

(86) PCT No.: PCT/DE2022/100587
§ 371 (c)(1),
(2) Date: Mar. 7, 2024

(87) PCT Pub. No.: WO2023/036356
PCT Pub. Date: Mar. 16, 2023

(65) Prior Publication Data

US 2024/0426229 A1 Dec. 26, 2024

(30) Foreign Application Priority Data

Sep. 7, 2021 (DE) ..... 102021123114.0

(51) Int. Cl.
*F01L 1/344* (2006.01)
*F01L 1/46* (2006.01)

(52) U.S. Cl.
CPC ..... *F01L 1/3442* (2013.01); *F01L 1/46* (2013.01); *F01L 2001/34426* (2013.01); *F01L 2001/3443* (2013.01); *F01L 2001/34433* (2013.01)

(58) Field of Classification Search
CPC ..... F01L 1/3442; F01L 2001/34426; F01L 2001/3443; F01L 2001/34433; F01L 1/46
(Continued)

(56) References Cited

U.S. PATENT DOCUMENTS 5,170,755 A * 12/1992 Kano ..... F01L 1/34406 123/90.31
2009/0025668 A1* 1/2009 Matsusaka ..... F01L 1/3442 464/160

(Continued)

FOREIGN PATENT DOCUMENTS

DE 196 04 865 B4 5/2009
DE 10 2017 109139 B3 6/2018

(Continued)

*Primary Examiner* — Jorge L Leon, Jr.
(74) *Attorney, Agent, or Firm* — Volpe Koenig

(57) ABSTRACT

The invention relates to a hydraulic camshaft adjuster (1) having a stator (2), a rotor (3) rotatable relative to the stator (2) within a limited angular range, and a hydraulic supply (4) having two working channels (5, 6) and a shifting valve (7), wherein the two working channels (5, 6) for adjusting the rotor (3) relative to the stator (2) in two opposite directions of action can be connected to a pump (10) for pressurisation or to a reservoir (11) for pressure relief, depending on the shifting position (8, 9) of the shifting valve (7), wherein the hydraulic supply (4) has a return pump (12) that can be actuated by displacing the shifting valve (7) between its shifting positions (8, 9) and by the actuation of which one of the two work-ing channels (6) can be pressurised for return-ing the rotor (3) into a predetermined position.

20 Claims, 1 Drawing Sheet

(58) Field of Classification Search
USPC ..... 123/90.17
See application file for complete search history.

(56) References Cited

U.S. PATENT DOCUMENTS

| | | | | |
|---|---|---|---|---|
| 2009/0101093 | A1* | 4/2009 | Ogawa | F01L 1/3442 123/90.17 |
| 2009/0288625 | A1* | 11/2009 | Toma | F01L 1/3442 464/160 |
| 2010/0175649 | A1* | 7/2010 | Suzuki | F02D 13/0215 123/90.17 |
| 2014/0283771 | A1* | 9/2014 | Mukaide | F01L 13/0063 123/90.15 |
| 2017/0159508 | A1* | 6/2017 | Kusanagi | F01L 1/3442 |
| 2017/0362973 | A1* | 12/2017 | Pegg | F01M 1/16 |

FOREIGN PATENT DOCUMENTS

| | | | |
|---|---|---|---|
| EP | 1966798 | B1 | 2/2010 |
| JP | H11 13429 | A | 1/1999 |

* cited by examiner

CAMSHAFT ADJUSTER WITH RESET FUNCTION

CROSS-REFERENCE TO RELATED APPLICATIONS

This application is the U.S. National Phase of PCT Appln. No. PCT/DE2022/100587, filed Aug. 10, 2022, which claims the benefit of German Patent Appln. No. 102021123114.0, filed Sep. 7, 2021, the entire disclosures of which are incorporated by reference herein.

TECHNICAL FIELD

The disclosure relates to a hydraulic camshaft adjuster for adjusting the phase position of a camshaft relative to a crankshaft in a motor vehicle drive train.

BACKGROUND

Hydraulic camshaft adjusters are known, for example, from JP H11-13 429AorDE 19604 865A1.

Hydraulic camshaft adjusters must have a rest position in the depressurized state, which is actively approached in the depressurized state. For example, it is common for the rotor and the stator to be adjusted to a defined position, such as a center position, in relation to one another in the depressurized state, from which the vehicle can be started. The return to the rest position is also referred to as the so-called fail-safe function.

Known hydraulic camshaft adjusters usually have an integrated spring mechanism for returning the rotor relative to the stator to the defined position/end position, the (mechanical) return force of which sets the rotor to the defined position in the depressurized state.

However, the prior art has the disadvantage that, on the one hand, such spring mechanisms incur additional costs and additional weight for the spring mechanism itself as well as the components accommodating the spring mechanism and, on the other hand, axial and radial installation space is required for the arrangement of the spring mechanism, so that the integration of a spring mechanism counteracts the requirement for a camshaft adjuster to be as compact as possible, in particular axially narrow and not to collide with a central magnet. In addition, the provision of such a spring mechanism has the disadvantages that there is a risk of spring failure during operation due to material failure and that the spring tension acting on the rotor, which acts in one of the two adjustment directions, applies a counter-torque to the rotor, which can lead to different adjustment speeds in one or the other adjustment direction.

SUMMARY

It is therefore the object of the disclosure to avoid or at least mitigate the disadvantages of the prior art and to provide a camshaft adjuster in which the above-described return to a defined position/rest position (fail-safe function) is implemented and which at the same time is constructed in a particularly cost-effective and weight-saving manner without restricting the functionality of the camshaft adjuster.

The object of the disclosure is achieved by a camshaft adjuster having the features of claim 1. Advantageous further developments are claimed in the dependent claims.

As such, the object of the disclosure is achieved in a generic camshaft adjuster according to the disclosure in that the hydraulic supply has a return pump that can be actuated by a displacement of the switching valve between its switching positions and by the actuation of which one of the two working channels can be pressurized for returning the rotor to a predetermined position.

This means that the object of the disclosure is achieved by a hydraulic camshaft adjuster, for example of the vane cell type, which has a first working chamber formed between the stator and the rotor, which can be supplied with hydraulic fluid/hydraulic medium/oil via a first working channel for adjusting the rotor relative to the stator in one direction of action, and a second working chamber formed between the stator and the rotor, which can be supplied with hydraulic fluid/hydraulic medium/oil via a second working channel for adjusting the rotor relative to the stator in the other direction of action, wherein the pressurization of the working chambers is controlled via the switching valve. In a normal adjustment mode, one of the working chambers is always connected to the pump for pressurization, while the other of the working chambers is connected to the reservoir for pressure relief. According to the disclosure, the switching valve is designed in such a way that it has a pump function (i.e., forms the return pump), in that hydraulic fluid/oil is drawn from an unpressurized reservoir and fed to one of the working chambers by means of cycled switching of the switching valve (and thus by a longitudinal movement of the switching valve (i.e., the switch adjustment movement)). In other words, the supply of hydraulic fluid to one of the working chambers results in the camshaft adjuster being returned to a predetermined position in the depressurized state, so that an electrohydraulic return function is implemented.

According to a preferred embodiment, the hydraulic supply can have a second switching valve which, in a first switching position, connects one of the two working channels (e.g., the second working channel) to the return pump and, in a second switching position, connects the two working channels to the pump or to the reservoir, depending on the switching position of the (first) switching valve. This means that in the second switching position, normal operation of the adjustment takes place, in which the working channels are pressurized and depressurized in a switchable manner, and in the first switching position, a return function is implemented, in which fluid is fed into one working chamber (e.g., the second working chamber) via the return pump and fluid is discharged from the other working chamber (e.g., the first working chamber) until the predetermined position is reached. This has the advantage that it is possible to switch between the normal function and the return function.

According to a further development of the preferred embodiment, the second switching valve can be designed to be pilot-controlled in an (oil/fluid) pressure-dependent manner, wherein the second switching valve is in the first switching position in a depressurized state of the pump and in the second switching position when pressure is built up at the pump. In particular, the second switching valve is actuated via a control line connected to the pump, by means of which the second switching valve is adjusted to its unactuated first switching position by the return force of a spring when there is no pressure in the control line and to its actuated second switching position against the return force of the spring when there is pressure in the control line. This ensures that in normal operation, when pressure is built up at the pump, the second switching valve is in the second switching position and is automatically in the first switching position in the depressurized state. In this way, a particularly simple way of controlling the second switching valve can be provided.

According to a further development of the preferred embodiment, the hydraulic supply can have a neutral line which connects the return pump to the reservoir in the second switching position of the second switching valve in order to form an open center separate from the working channels. This has the advantage that the adjustment function cannot be influenced by the return pump during normal operation.

According to a further development of the preferred embodiment, another one of the two working channels (e.g., the first working channel) in the first switching position of the second switching valve can be connected via a throttle to a first line and, preferably without throttling, to a second line, wherein the first line and the second line connect the same working channel (e.g., the first working channel) to the pump or to the reservoir, depending on the switching position of the (first) switching valve. By means of throttling, a sufficiently high differential pressure can be provided for the second switching valve.

According to a further development of the preferred embodiment, the second switching valve can be designed as a sleeve structure which is arranged coaxially around the switching valve. This has the advantage that the second switching valve can be integrated into existing camshaft adjusters in a cost-effective and space-saving manner.

According to a preferred embodiment, a pump piston of the return pump can be integrally formed by a switching valve armature/switching valve slide of the (first) switching valve. According to an alternative preferred embodiment, a pump piston of the return pump can be designed to be connected in series with a switching valve armature/switching valve slide of the (first) switching valve. This means that the longitudinal movement of the switching valve armature is directly coupled to the pump piston, so that a cycled switching of the (first) switching valve actuates the return pump and thus implements the return of the rotor. This means that the return spring previously used to return the rotor to the predetermined position can be replaced by existing components.

According to a preferred embodiment, the return pump can be connected to an unpressurized reservoir via a suction line, wherein the reservoir is formed in a cavity in the camshaft adjuster. This has the advantage that the suction line can be designed to be comparatively short, for example.

According to a preferred embodiment, the return pump can be designed such that its volume flow is greater than 1.2 l/min. In this way, the volume flow required to return the rotor can be provided.

In other words, in the camshaft adjuster according to the disclosure, the return functionality is not implemented by means of a spring mechanism as in known camshaft adjusters, but by means of components or subsystems already present in the camshaft adjuster system. The camshaft adjuster thus differs from known camshaft adjusters in that the return is performed by means of cycled switching of the modified, electrohydraulic switching valve instead of in a spring-driven manner, wherein the modification consists of an additional pumping function during the longitudinal movement of the switching valve armature. The pumping function can be implemented, for example, by a series-connected design or preferably an integral design of the switching valve armature of the pump piston. Alternatively, other pump concepts, such as diaphragm pumps, are also conceivable. In a first operating state, the camshaft adjuster is in a depressurized state, which is the case when the engine is at a standstill, for example, as the lubricating oil pump cannot build up any supply pressure. By means of a cycling of the switching valve as initiated by the ECU (engine control unit), oil is drawn in from an unpressurized reservoir, e.g., a cavity in the camshaft adjuster, and fed to the camshaft adjuster via a pressure line and a directional valve pilot-controlled in an engine oil pressure-dependent manner in order to move it to a predetermined position/preferred position. The directional valve can preferably be a sleeve structure arranged coaxially around the switching valve, which is axially displaced by the engine oil pressure against a return spring and accordingly releases/closes the required oil paths. In a second operating state, for example after starting the engine or when engine oil pressure is present, a standard adjustment function of the camshaft adjuster is provided. In addition, a slight throttling of the oil flow may be necessary in order to provide sufficient differential pressure for the pilot-controlled directional valve. In addition, an open center can be provided for the pump function, which prevents any influence on the switching behavior of the electrohydraulic switching valve in this operating state.

BRIEF DESCRIPTION OF THE DRAWINGS

The disclosure is explained below with the aid of drawings. In the figures.

The figures are merely schematic in nature and serve solely for understanding the disclosure. Identical elements are provided with the same reference symbols. The features of the individual embodiments can be interchanged.

DETAILED DESCRIPTION

Figure 1:
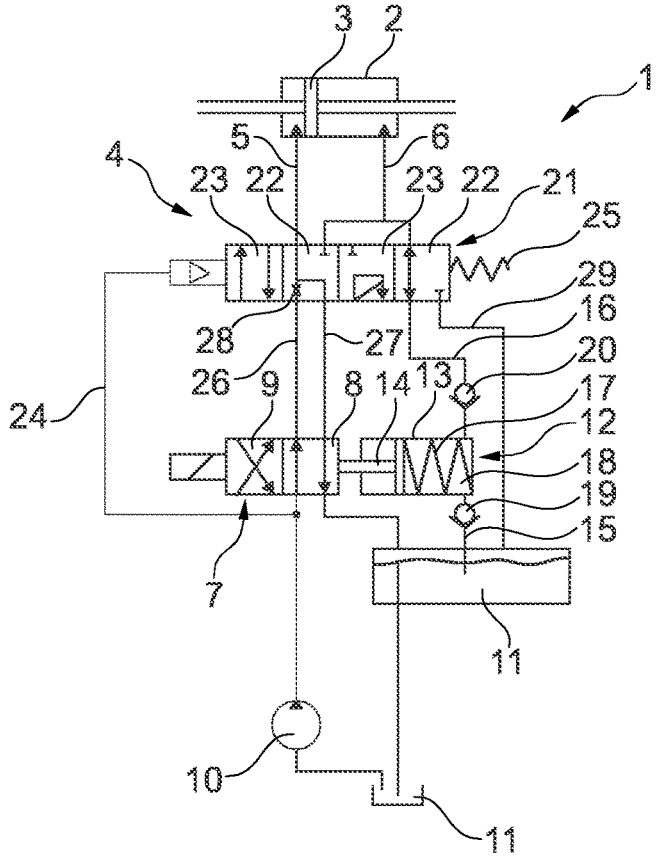
FIG. 1 shows a schematic representation of a camshaft adjuster according to the disclosure in a first operating state.
Figure 2:
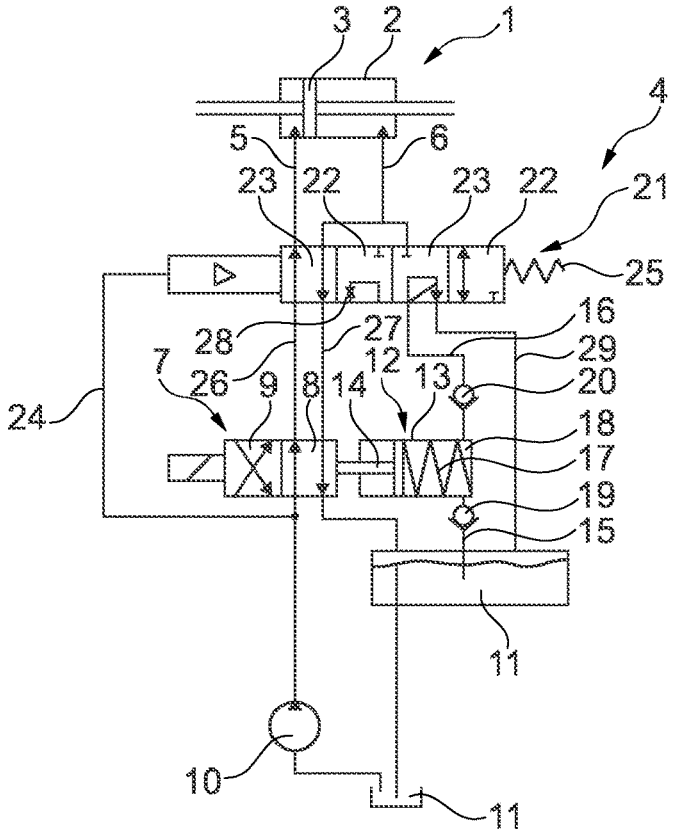
FIG. 2 shows a schematic representation of the camshaft adjuster according to the disclosure in a second operating state.

FIGS. 1 and 2 show a hydraulic camshaft adjuster 1 according to the disclosure in two different operating modes. The camshaft adjuster 1 is used for adjusting the phase position of a camshaft relative to a crankshaft in a motor vehicle drive train. The camshaft adjuster 1 has a stator 2 and a rotor 3 that can be rotated/adjusted relative to the stator 2 within a limited angular range. The stator 2 is rotationally coupled to the crankshaft and the rotor 3 is rotationally coupled to the camshaft. In the figures, the stator 2 and the rotor 3 are only shown by way of example as a double-acting hydraulic cylinder, wherein an adjustment of the hydraulic cylinder in one direction symbolizes a rotation of the rotor 3 in a first direction of action and an adjustment of the hydraulic cylinder in the other direction symbolizes a rotation of the rotor 3 in a second direction of action opposite to the first direction of action.

In order to adjust the rotor 3 relative to the stator 2, the camshaft adjuster 1 has a hydraulic supply system 4, which is shown in the figures in the form of a hydraulic circuit diagram. The hydraulic supply system 4 has a first working channel 5, which is connected to a first working chamber formed between the rotor 3 and the stator 2, and a second working channel 6, which is connected to a second working chamber formed between the rotor 3 and the stator 2. When pressure is applied to the first working channel 5 (or the first working chamber) (and pressure is relieved from the second working channel 6), the rotor 3 is adjusted in the first direction of action (to the right in the figures). When pressure is applied to the second working channel 6 (or the second working chamber) (and pressure is relieved from the first working channel 5), the rotor 3 is adjusted in the second direction of action (to the left in the figures).

The hydraulic supply system 4 has a first switching valve 7, which can be adjusted between a first switching position 8 and a second switching position 9. In the embodiment shown, the first switching valve 7 is designed as a 2/2-way valve or a 4/2-way valve. In the first switching position 8, the first working channel 5 can be connected or is connected to a pump 10 for pressurization, and the second working channel 6 can be connected or is connected to a tank/reservoir 11 for pressure relief. In the second switching position 9, the first working channel 5 can be connected or is connected to the tank/reservoir 11 for pressure relief, and the second working channel 6 can be connected or is connected to the pump 10 for pressurization. The first switching valve 7 is designed as an electrohydraulic valve that can be actuated/switched by a control unit (ECU) not shown.

According to the disclosure, the hydraulic supply system 4 has a return pump 12. The return pump 12 can be actuated/operated by a displacement of the first switching valve 7 between its switching positions 8, 9. This means that an additional pumping function is provided during a longitudinal movement of the first switching valve 7. By actuating the return pump 12, one of the two working channels 5, 6, in the embodiment shown the second working channel 6, can be pressurized in order to return the rotor 3 to a predetermined (rest) position.

In the embodiment shown, the return pump 12 has a pump piston 14 that can be displaced in a pump chamber 13, by the displacement of which hydraulic fluid can be drawn from the tank/reservoir 11 via a suction line 15 and introduced into the second working channel 6 via a pressure line 16. The pump piston 14 is moved by the longitudinal movement/switching movement of the first switching valve 7. The pump piston 14 can, for example, reduce the size of a pressure chamber 18 connected to the suction line 15 and/or the pressure line 16 against the return force of a spring 17. A check valve 19 can be arranged in the suction line 15, which prevents a reverse flow from the pressure chamber 18 into the reservoir 11 via the suction line 15. A check valve 20 can also be arranged in the pressure line 16, which prevents a reverse flow from the second working channel 6 into the pressure chamber 18 via the pressure line 16.

Preferably, the pump piston 14 can be integrally formed by a switching valve armature/switching valve slide of the first switching valve 7. Alternatively, the pump piston 14 can be designed to be connected in series with the switching valve armature/switching valve slide of the first switching valve 7. Further alternatively, the return pump 12 can be designed as a diaphragm pump or the like, even if this is not shown.

Between the working channels 5, 6 and the first switching valve 7 or the return pump 12, a second switching valve 21 in the form of a directional valve is arranged, which can be adjusted between a first switching position 22 and a second switching position 23. The second switching valve 21 is pilot-controlled depending on the oil pressure of the pump 10. This means that the second switching valve 21 is actuated via a control line 24 connected to the pump 10 and is in the unactuated first switching position 22 (cf. FIG. 1) when the pump 10 is in the depressurized state and in the actuated second switching position 23 (cf. FIG. 2) when the pump 10 is pressurized against the return force of a spring 25.

In the first switching position 22, of the second switching valve 21, the first working channel 5 is connected to a line 26, which is connected to the pump 10 in the first switching position 8 of the first switching valve 7, and to a line 27, which is connected to the reservoir 11 in the first switching position 8 of the first switching valve 7. In the first switching position 22 of the second switching valve 21, the first working channel 5 is connected to the line 26 via a throttle 28 limiting the fluid flow. The second working channel 6 is connected to the pressure line 16 in the first switching position 22 of the second switching valve 21. By means of an initiated cycling of the first switching valve 7, the return pump 12 draws fluid from the reservoir 11 and feeds it into the second working chamber via the pressure line 16 and the second switching valve 21, so that the rotor 3 is adjusted to the predetermined (rest) position/default position. Fluid can be discharged from the first working chamber via the line 27.

In the second switching position 23 of the second switching valve 21, the first working channel 5 is connected to the line 26, which is connected to the pump 10 in the first switching position 8 of the first switching valve 7 and is connected to the reservoir 11 in the second switching position 9 of the first switching valve 7. In the second switching position 23 of the second switching valve 21, the second working channel 6 is connected to the line 27, which is connected to the reservoir 11 in the first switching position 8 of the first switching valve 7 and is connected to the pump 10 in the second switching position 9 of the first switching valve 7. In the second switching position 23 of the second switching valve 21, the pressure line 16 is connected to the reservoir 11 via a neutral line 29. As a result, the return pump 12 has an open center in the second switching position 23 of the second switching valve 21, so that the switching behavior of the first switching valve 7 is not influenced.

LIST OF REFERENCE SYMBOLS

1 Camshaft adjuster
2 Stator
3 Rotor
4 Hydraulic supply
5 First working channel
6 Second working channel
7 Switching valve
8 First switching position
9 Second switching position
10 Pump
11 Reservoir
12 Return pump
13 Pump chamber
14 Pump piston
15 Suction line
16 Pressure line
17 Spring
18 Pressure chamber
19 Check valve
20 Check valve
21 Second switching valve
22 First switching position
23 Second switching position
24 Control line
25 Spring
26 First line
27 Second line

28 Throttle
29 Neutral line

The invention claimed is:

1. A hydraulic camshaft adjuster for adjusting a phase position of a camshaft relative to a crankshaft in a motor vehicle drive train, the hydraulic camshaft adjuster comprising:

a stator, a rotor configured to rotate relative to the stator within a predetermined angular range, and a hydraulic supply system configured to control the relative rotation of the rotor, the hydraulic supply system including:

a first working channel, a second working channel, a first switching valve configured to switch between (i) a first switching position in which the first working channel and the second working channel are respectively connected to a pressurizing pump and a pressure relieving reservoir, and (ii) a second switching position in which the second working channel and the first working channel are respectively connected to the pressurizing pump and the reservoir, and a return pump actuated via a switching movement of the first switching valve, the return pump configured to pressurize one working channel of the first and second working channels so as to return the rotor to a predetermined rotational position relative to the stator.

2. The hydraulic camshaft adjuster according to claim 1, wherein the hydraulic supply system further includes a second switching valve interposed between the first switching valve and the first and second working channels, the second switching valve configured to switch between (i) a first switching position in which the one working channel is connected to the return pump, and (ii) a second switching position in which the first and second working channels are alternately connected to the pressurizing pump and the reservoir in accordance with the switching position of the first switching valve.

3. The hydraulic camshaft adjuster according to claim 2, wherein the second switching valve is pilot-controlled in a pressure-dependent manner such that the second switching valve switches to the first switching position when the pressurizing pump is in a depressurized state, and the second switching valve switches to the second switching position when the pressurizing pump is in a pressurized state.

4. The hydraulic camshaft adjuster according to claim 2, wherein the hydraulic supply system further includes a neutral line configured to connect the return pump to the reservoir when the second switching valve is in the second switching position so as to form an open center separate from the first and second working channels.

5. The hydraulic camshaft adjuster according to claim 2, wherein the first switching valve is connected to the second switching valve via a first line and a second line, wherein, in the first switching position of the second switching valve, a remaining working channel of the first and second working channels is connected via a throttle to the first line and the second line, and wherein the first line and the second line are alternately connected to the pressurizing pump and the reservoir in accordance with the switching position of the first switching valve.

6. The hydraulic camshaft adjuster according to claim 2, wherein the second switching valve includes a sleeve structure arranged coaxially around the first switching valve.

7. The hydraulic camshaft adjuster according to claim 1, wherein the first switching valve includes an integrally formed switching valve armature serving as a pump piston of the return pump.

8. The hydraulic camshaft adjuster according to claim 1, wherein the first switching valve includes a switching valve armature configured to drive a pump piston of the return pump.

9. The hydraulic camshaft adjuster according to claim 1, wherein the return pump is connected to an unpressurized reservoir via a suction line, and wherein the reservoir is formed in a cavity in the camshaft adjuster.

10. The hydraulic camshaft adjuster according to claim 1, wherein a volumetric flowrate through the return pump is greater than 1.2 l/min.

11. A method of adjusting a phase position of a camshaft relative to a crankshaft in a motor vehicle drive train, the method comprising:

providing a hydraulic camshaft adjuster including:

a stator, a rotor configured to rotate relative to the stator within a predetermined angular range, and a hydraulic supply system configured to control the relative rotation of the rotor, the hydraulic supply system including:

a first working channel, a second working channel, a first switching valve configured to switch between (i) a first switching position in which the first working channel and the second working channel are respectively connected to a pressurizing pump and a pressure relieving reservoir, and (ii) a second switching position in which the second working channel and the first working channel are respectively connected to the pressurizing pump and the reservoir, and a return pump actuated via a switching movement of the first switching valve, the return pump configured to pressurize one working channel of the first and second working channels so as to return the rotor to a predetermined rotational position relative to the stator; and selectively switching the first switching valve between the first and second switching positions.

12. The method according to claim 11, wherein the hydraulic supply system further includes a second switching valve which interposed between the first switching valve and the first and second working channels, the second switching valve configured to switch between (i) a first switching position in which the one working channel is connected to the return pump, and (ii) a second switching position in which the first and second working channels are alternately connected to the pressurizing pump and the reservoir in accordance with the switching position of the first switching valve.

13. The method according to claim 12, wherein the second switching valve is pilot-controlled in a pressure-dependent manner such that the second switching valve switches to the first switching position when the pressurizing pump is in a depressurized state, and the second switching valve switches to the second switching position when the pressurizing pump is in a pressurized state.

14. The method according to claim 13, wherein the hydraulic supply system further includes a neutral line configured to connect the return pump to the reservoir when the second switching valve is in the second switching position so as to form an open center separate from the first and second working channels.

15. The method according to claim 12, wherein the first switching valve is connected to the second switching valve via a first line and a second line, wherein, in the first switching position of the second switching valve, a remaining working channel of the first and second working channels is connected via a throttle to the first line and the second line, and wherein the first line and the second line are alternately connected to the pressurizing pump and the reservoir in accordance with the switching position of the first switching valve.

16. The method according to claim 12, wherein the second switching valve includes a sleeve structure arranged coaxially around the first switching valve.

17. The method according to claim 11, wherein the first switching valve includes an integrally formed switching valve armature serving as a pump piston of the return pump.

18. The method according to claim 11, wherein the first switching valve includes a switching valve armature configured to drive a pump piston of the return pump.

19. The method according to claim 11, wherein the return pump is connected to an unpressurized reservoir via a suction line, and wherein the reservoir is formed in a cavity in the camshaft adjuster.

20. The method according to claim 11, wherein a volumetric flowrate through the return pump is greater than 1.2 l/min.

* * * * *